US006525486B2

(12) United States Patent
Awamoto et al.

(10) Patent No.: US 6,525,486 B2
(45) Date of Patent: Feb. 25, 2003

(54) METHOD AND DEVICE FOR DRIVING AN AC TYPE PDP

(75) Inventors: Kenji Awamoto, Kawasaki (JP); Yasunobu Hashimoto, Kawasaki (JP); Koichi Sakita, Kawasaki (JP); Kunio Takayama, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/021,083

(22) Filed: Dec. 19, 2001

(65) Prior Publication Data

US 2003/0001512 A1 Jan. 2, 2003

(30) Foreign Application Priority Data

Jun. 29, 2001 (JP) ..... 2001-199011

(51) Int. Cl.[7] ..... G09G 3/10; G09G 3/28
(52) U.S. Cl. ..... 315/169.4; 345/60
(58) Field of Search ..... 315/169.4, 169.3; 345/60, 62, 63, 66, 67, 68, 69, 204, 208, 209

(56) References Cited

U.S. PATENT DOCUMENTS 5,745,086 A 4/1998 Weber ..... 345/63
5,952,986 A * 9/1999 Nguyen et al. ..... 345/68
2001/0040539 A1 * 11/2001 Hashimoto ..... 345/60
2002/0054001 A1 * 5/2002 Awamoto ..... 345/60
2002/0060651 A1 * 5/2002 Yamamoto et al. ..... 345/60
2002/0122016 A1 * 9/2002 Iwasa et al. ..... 345/60
2002/0130823 A1 * 9/2002 Takayama ..... 345/60

* cited by examiner

*Primary Examiner*—Don Wong
*Assistant Examiner*—Chuc Trand
(74) *Attorney, Agent, or Firm*—Staas & Halsey LLP

(57) ABSTRACT

A method for driving an AC type plasma display panel is provided in which time necessary for addressing can be shortened without deteriorating stability of a display. Before the addressing, a reset process is performed by applying an increasing waveform voltage between a reference potential line and a scan electrode so as to equalize charge in all cells. In the addressing, a selection voltage Vya1 having the same polarity as a final applied voltage Vyr2 in the reset process and an absolute value larger than the voltage Vyr2 by a potential difference ΔVy is applied between a scan electrode corresponding to a selected row and the reference potential line.

8 Claims, 10 Drawing Sheets

METHOD AND DEVICE FOR DRIVING AN AC TYPE PDP

BACKGROUND OF THE INVENTION

1. Field of the Invention

The present invention relates to a method and a device for driving an AC type plasma display panel.

A plasma display panel (a PDP) unites high speed and high resolution suitable for a television set as well as a computer monitor and is used as a large screen display device. As it comes into wide use, its using environment becomes diversified. Therefore, a driving method is desired that realizes a stable display insusceptible of temperature variation or voltage regulation of a power source. It is also an important subject to reduce power consumption.

2. Description of the Prior Art

As a color display device, a surface discharge format AC type PDP is commercialized. The surface discharge format means a structure in which display electrodes (first electrodes and second electrodes) that are anode and cathode in display discharge for securing luminance are arranged on a front or a back substrate in parallel, and address electrodes (third electrodes) are arranged so as to cross the display electrode pairs. There are two forms of display electrode arrangement. In the first form, a pair of display electrodes is arranged for one row of a matrix display. In the second form, the first display electrode and the second display electrode are arranged alternately at a constant pitch, so that each display electrode except both ends of the arrangement works for two rows (lines) of a display. Regardless of the arrangement form, the display electrode pairs are covered with a dielectric layer.

In a display using a surface discharge format PDP, one of the two display electrodes corresponding to a row (the second electrode) is used as a scan electrode for selecting a row, so as to generate address discharge between the scan electrode and the address electrode, which causes address discharge between the display electrodes. Thus, electrostatic charge quantity in the dielectric layer (wall charge quantity) is controlled in accordance with contents of a display in addressing. After the addressing, a sustaining voltage Vs having alternating polarities is applied to the display electrode pair. The sustaining voltage Vs satisfies the following inequality (1).

$$Vf_{XY}-Vw_{XY}<Vs<Vf_{XY} \quad (1)$$

Here, $Vf_{XY}$ denotes a discharge start voltage between the display electrodes, and $Vw_{XY}$ denotes the wall voltage between the display electrodes.

When the sustaining voltage Vs is applied, a cell voltage (the sum of a driving voltage that is applied to the electrode and the wall voltage) exceeds the discharge start voltage $Vf_{XY}$ and surface discharge is generated on the surface of the substrate only in cells having a predetermined quantity of wall charge. As the application period is shortened, light emission looks as if it is continuous.

A discharge cell of a PDP is basically a binary light emission element. Therefore, a half tone is reproduced by setting integral light emission quantity of each discharge cell in a frame period in accordance with a gradation value of input image data. A color display is one type of a gradation display, and a display color is determined by combining luminance values of three primary colors. The gradation display is realized by making one frame of plural subframes (or subfields in an interlace display) having luminance weights and by setting the integral light emission quantity combining on and off of the light emission for each subframe.

FIG. 9 is a diagram of voltage waveforms showing a general driving sequence. In FIG. 9, reference letters X, Y and A denote the first display electrode, the second display electrode and the address electrode, respectively. Suffixes 1–n of X and Y denote arrangement orders of rows corresponding to display electrodes X and Y. Suffixes 1–m of A denote arrangement orders of columns corresponding to address electrodes A.

A subframe period Tsf assigned to each subframe is divided into a reset period TR for equalizing charge distribution in a screen, an address period TA for forming the charge distribution corresponding to contents of a display by applying a scan pulse Py and an address pulse Pa and a sustain period (or a display period) TS for securing a luminance value corresponding to a gradation value by applying a display pulse Ps. The lengths of the reset period TR and the address period TA do not change regardless of the luminance weight, while the length of the sustain period TS is longer as the luminance weight is larger. The driving sequence is repeated for each subframe in the order of the reset period TR, the address period TA and the display period TS.

When the sustain period of each subframe finishes, there are discharge cells having relatively much wall charge and discharge cells having little wall charge. In order to increase reliability of the addressing of the next subframe, a reset process for charge equalization is performed in the reset period TR.

U.S. Pat. No. 5,745,086 discloses a reset process in which a first ramp voltage and a second ramp voltage are applied to a discharge cell sequentially. When a ramp voltage having a mild gradient (an increasing waveform voltage) is applied, light emission in the reset process is made minute so as to prevent a contrast from dropping because of the characteristics of microdischarge as explained below. In addition, the wall voltage can be set to any target value regardless of variation of a cell structure.

If the gradient of the ramp voltage is mild, minute charge adjustment discharges are generated plural times in the rising process of the applied voltage. When the gradient is made milder, discharge intensity is reduced and a discharge period is shortened so that the discharge transfers to a continuous discharge form. In the following explanation, periodical charge adjustment discharge and continuous charge adjustment discharge are collectively called "microdischarge".

In the microdischarge, the wall voltage can be controlled by setting the maximum final voltage of the ramp waveform. During the microdischarge, even if the cell voltage Vc (i.e., the wall voltage Vw plus an applied voltage Vi) that is applied to a discharge space exceeds discharge start threshold level (hereinafter, denoted by Vt) because of increase of the ramp voltage, the cell voltage is always maintained in the vicinity of the voltage Vt thanks to the generation of microdischarge. The microdischarge reduces the wall voltage by the same amount as the increase of the ramp voltage. Supposing the final value of the ramp voltage is Vr, and the wall voltage is Vw when the ramp voltage reaches the final value Vr, the following equation is satisfied since the cell voltage Vc is kept at Vt.

$$Vc=Vr+Vw=Vt, \text{ therefore}$$

$$Vw=-(Vr-Vt)$$

Since the voltage Vt has a constant value determined by electric characteristics of the discharge cell, the wall voltage can be set to any desired value by setting the final value Vr of the ramp voltage. More specifically, even if there is a minute difference in the voltage Vt between the discharge cells, the difference between the voltages Vt and Vw of each of all discharge cells can be equalized.

In the example shown in FIG. 9, the first ramp voltage ascending to a voltage Vyr1 is applied to the display electrode Y, so that wall charge is formed between the display electrode X and the display electrode Y (referred to as interelectrode XY) as well as between the display electrode Y and the address electrode A (referred to as interelectrode AY). After that, the second ramp voltage descending to a voltage Vyr2 is applied to the display electrode Y, so that the wall voltage at the interelectrode XY and the wall voltage at the interelectrode AY get close to a target value. In synchronization with the application of the ramp voltage, potentials Vxr1 and Vxr2 are applied to the display electrode X. The application of a voltage means to bias an electrode so as to generate a predetermined voltage between the electrode and a reference potential. The voltage values Vxr1 and Vyr1 are selected so that microdischarge is generated at the second ramp voltage without fail.

After this reset process, the addressing is performed. In the address period TA, all the display electrodes Y are biased to a non-selection potential Vya2 at the start point, and then display electrodes Y corresponding to selected row i ($1 \leqq i \leqq n$) are biased temporarily to a selection potential Vya1 (application of the scan pulse). In synchronization with the row selection, the address electrodes A are biased to the selection potential Va only in the columns of the selected row, to which the selected cells that generate address discharge belong (application of the address pulse). The address electrode A of a column to which the non-selected cells belong is set to the reference potential (usually zero volts). The display electrode X is biased to a constant potential Vxa from the start to the end of the addressing regardless of whether the row is a selected row or a non-selected row. In the sustain period TS, the display pulse Ps having the amplitude Vs is applied to the display electrode Y and the display electrode X alternately. The number of application times is substantially proportional to the luminance weight.

In the conventional method, the voltage Vyr2 that is applied to the display electrode Y during the reset period TR is the same as the selection voltage Vya1 that is applied in the address period TA, and a common power source is used for applying the two voltages. Furthermore, the voltage Vxr2 that is applied to the display electrode X during the reset period TR is the same as the bias voltage Vxa in the address period TA.

FIG. 10 is a timing chart of addressing in the conventional method. In FIG. 10, the time relationship between the scan pulse for the j-th row (line) and the address discharge is illustrated. The row selection potential is Vya1, the row non-selection potential is Vya2, the address selection potential is Va and the address non-selection potential is a reference potential (e.g., zero volts).

When the scan pulse is applied to the display electrode Y corresponding to the j-th row, and the address voltage Va is applied to the address electrode A, address discharge is generated at the interelectrode AY. At the same time substantially, address discharge is generated also at the interelectrode XY, so that wall charge is formed inside the cell. In other words, a wall voltage $Vw_{xy-a}$ is generated at the interelectrode XY with respect to the negative display electrode X.

The address discharge becomes the maximum after a time $t_{peak}$ delay from the start of the scan pulse application and finishes when a time $t_{end}$ passes. The lengths of the time $t_{peak}$ and the time $t_{end}$ depend on contents of the display and the address voltage Va and are affected by a panel temperature and variation of the cell structure.

In the conventional method, the address voltage Va is set to a value of approximately 70 volts, and the time $t_{end}$ is approximately 2 microseconds. The driving process requires a time $t_{d2}$ for resetting the electrode to the non-selection potential after the address discharge is finished. If a common circuit device is used, the time $t_{d2}$ is 0.2 microseconds, and time necessary for addressing one row (i.e., an address cycle) Tac' is 2.2 microseconds.

For example, supposing the number of rows of a display screen is 500, the number of subframes is 10 and time necessary for a reset process of one subframe is 300 microseconds, the total sum of the reset period and the address period of one frame becomes $(300+2.2\times500)\times10=14000$ microseconds (=14 milliseconds). Since a frame period of a full motion picture is approximately 16.7 milliseconds, time that can be assigned to the sustain period is approximately 2.7 (=16.7−14) milliseconds.

If the reset period is shortened and the sustain period is elongated so as to increase luminance of a display, the charge cannot be equalized sufficiently, resulting in an unstable display. If the address cycle Tac' is shortened, application of the address voltage should be finished before the address discharge finishes. As a result, the wall voltage $Vw_{xy-a}$ after the address discharge becomes insufficient, which makes a display unstable. In addition, if the address voltage Va is raised for shortening the address cycle Tac', power consumption in the addressing increases.

SUMMARY OF THE INVENTION

An object of the present invention is to shorten the time necessary for addressing without deteriorating stability of a display. Another object is to reduce power consumption in addressing.

According to the present invention, a method comprises the steps of applying an increasing waveform voltage between a reference potential line and a scan electrode so as to perform a reset process in which charge is equalized in all cells before addressing, and applying a selection voltage Vya1 having the same polarity as a final applied voltage Vyr2 in a reset process and being higher (an absolute value is larger) than the voltage Vyr2 by a potential difference ΔVy between the scan electrode corresponding to a selected row and the reference potential line in the addressing.

In the conventional driving method, the voltage Vya1 is equal to the voltage Vyr2. Therefore, if an amplitude of the scan pulse is changed, the voltage Vyr2 also changes. Accordingly, it is found that even if the selection voltage Vya1 is increased, the address cycle Tac cannot be shortened. In order to explain this, threshold level voltages at which microdischarge can be generated at the interelectrode XY and the interelectrode AY are supposed to be $Vt_{xy}$ and $Vt_{ay}$, and cell voltages are supposed to be $Vc_{xy}$ and $Vc_{ay}$. Also, applied voltages are supposed to be $Vr_{xy}$ and $Vr_{ay}$.

After the microdischarge starts, even if the applied voltages $Vr_{xy}$ and $Vr_{ay}$ are increased, the cell voltages $Vc_{xy}$ and $Vc_{ay}$ are maintained to be equal to the threshold level voltages $Vt_{xy}$ and $Vt_{ay}$, respectively.

In a period while the increasing waveform voltage is applied and microdischarge is generated, the following equations are satisfied.

$$Vt_{xy}=Vr_{xy}+Vw_{xy}$$

$$Vt_{ay}=Vr_{ay}+Vw_{ay}$$

$Vw_{xy}$ and $Vw_{ay}$ denote wall voltages at the interelectrode XY and the interelectrode AY.

When the applied voltage of the display electrode Y reaches Vyr2 while the voltage Vxr2 is applied to the display electrode X and the address electrode A is biased to the reference potential, the following equations are satisfied.

$$Vc_{ay}=Vyr2+Vw_{ay}=Vt_{ay}$$

$$Vc_{xy}=Vyr2+Vxr2+Vw_{ay}=Vt_{xy}$$

After that, in the address period, when the selection voltage Vya1 (=Vyr2) is applied to a certain display electrode Y, the address voltage Va is applied to an address electrode A, and the voltage Vxa(=Vxr2) is applied to a display electrode X, the following equations are satisfied.

$$Vc_{ay}=Vyr2+Vw_{ay}+Va=Vt_{ay}+Va$$

$$Vc_{xy}=Vyr2+Vxr2+Vw_{ay}=Vt_{xy}$$

In this case, even if the voltages at the interelectrode AY and the interelectrode XY are raised, the voltage at the discharge gap does not change at all since $Vc_{ay}=Vt_{ay}+Va$, and $Vc_{xy}=Vt_{xy}$. Therefore, as mentioned above, the address cycle Tac is not shortened.

On the contrary, according to the present invention, as shown in FIG. 1, in the reset period TR, the display electrode Y is supplied with the increasing waveform voltage that reaches the voltage Vyr2 at the end of the reset period TR, and the display electrode X is supplied with the voltage Vxr2. Then, in the address period TA, the display electrode Y corresponding to the selected row is supplied with the selection voltage Vya1 that is higher than the voltage Vyr2 by the potential difference ΔVy. The polarity of the potential difference ΔVy is selected so that the potential differences at the interelectrode XY and the interelectrode AY are increased.

The potential Vxa of the display electrode X in the address period TA is set to a value equal to the voltage Vxr or a value that is the voltage Vxr plus the potential difference ΔVx such that the potential difference at the interelectrode XY increases. In addition, the potential of the address electrode A in the address period TA is set to the same value as that at the end of the reset period TR.

In this case, in the address period TA, when the display electrode Y corresponding to the selected row is supplied with the selection voltage Vya1 (=Vyr2+ΔVy), the address electrode A is supplied with the address voltage Va, and the display electrode X is supplied with the bias voltage Vxa(=Vxr2+ΔVx), the following equations are satisfied.

$$Vc_{ay}=Vt_{ay}+Va+\Delta Vy$$

$$Vc_{xy}=Vt_{xy}+\Delta Vy+\Delta Vx$$

According to the driving method of the present invention, the cell voltages $Vc_{ay}$ and $Vc_{xy}$ that are applied to discharge gaps of the interelectrode AY and the interelectrode XY become higher than the conventional method by potential differences ΔVy and ΔVy+ΔVx, respectively. Thus, the time $t_{peak}$ and the time $t_{end}$ for the address discharge shown in FIG. 2 can be shortened compared to the conventional method.

Here, the relationships between the potential difference ΔVy and the time $t_{peak}$ as well as the time $t_{end}$, which are measured with the potential difference ΔVx as a parameter, are shown in FIG. 3. It is found that the delay time of the address discharge increases if the value of the potential difference ΔVy is increased too much, though the delay time of the address discharge is shortened if the value of the potential difference ΔVy is increased appropriately. It is also found that the value of the potential difference ΔVx affects the delay time of the address discharge less than the potential difference ΔVy does, so the potential difference ΔVx can be zero. The relationships between the potential difference ΔVy and the time $t_{peak}$ as well as the time $t_{end}$ when the potential difference ΔVx is zero are shown in FIG. 4.

As shown in FIG. 4, it is understood that a stable fast addressing can be performed when the potential difference ΔVy is set to a value within the range of 10–35 volts for shortening the delay time of the address discharge. It is understood from FIG. 4 that when 10 volts<ΔVy<35 volts, the time $t_{end}$ from the leading edge of the pulse to the end of the address discharge is approximately 0.8–1.2 microseconds.

In real drive, it is desirable to set the address cycle Tac in prospect of the time $t_{d2}$ necessary for resetting the electrode potential to the non-selection state as shown in FIG. 2. However, it is not always necessary to reset the electrode potential after the address discharge finishes completely. A time point close to the end of the address discharge can be used as the trailing edge of the pulse without affecting the stability of the display substantially.

From the above-mentioned facts, stable addressing can be performed under the condition of ΔVx=0 volts, 10 volts<ΔVy<35 volts, and 0.8 microseconds<Tac<1.4 microseconds. Since the address cycle Tac is shortened compared to the conventional method, the shortened portion can be assigned to the sustain period, so that the number of display discharge times can be increased and the luminance can be raised.

The present invention has another effect. FIG. 5 is a graph showing a margin of the address voltage Va. A stable display can be obtained by setting the voltage Va to a value within the range between two thick lines in FIG. 5. It is understood from FIG. 5 that the voltage Va should be set to a value within the range of 30–50 volts when the potential difference ΔVy is in the range of 10–35 volts as mentioned above. Compared to the conventional method in which the address voltage Va is set to approximately 70 volts, power consumption in the address period can be reduced substantially.

DESCRIPTION OF THE PREFERRED EMBODIMENTS

Hereinafter, the present invention will be explained more in detail with reference to embodiments and drawings.

Figure 6:
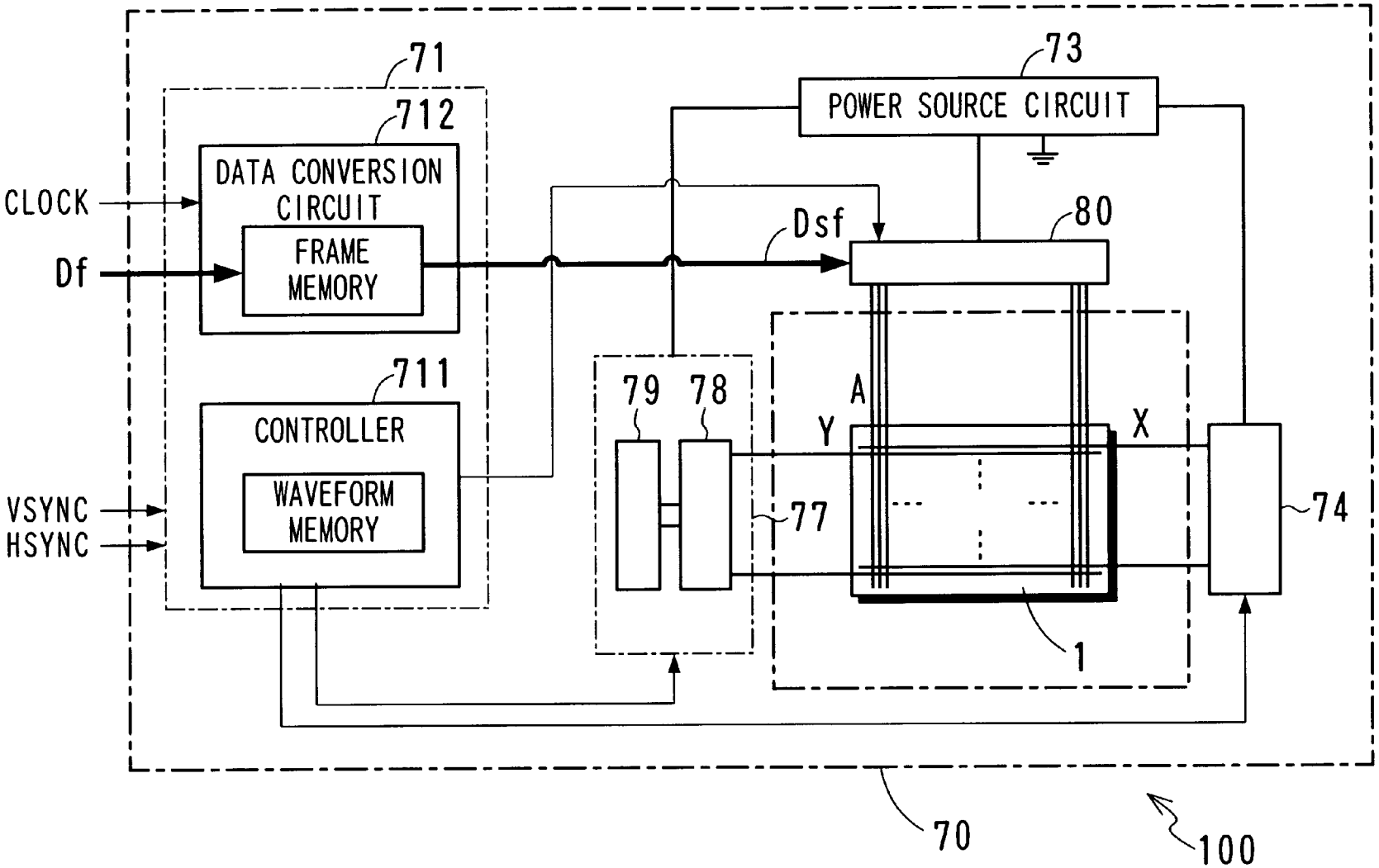
FIG. 6 shows a structure of a display device according to the present invention.

FIG. 6 shows a structure of a display device according to the present invention. The display device 100 comprises a three-electrode surface discharge format AC type PDP 1 having a display screen of m×n cells and a drive unit 70 for making the cells emit light selectively. The display device 100 is used as a wall-hung television set or a monitor of a computer system.

The PDP 1 includes display electrodes X and Y for generating display discharge. A pair of display electrodes X and Y is arranged in parallel for one row, and address electrodes A are arranged so as to cross the total 2n display electrodes. The display electrodes X and Y extend in the horizontal direction of the display screen. The display electrode Y is used as a scan electrode for selecting a row in the addressing. The address electrode A extends in the vertical direction.

The drive unit 70 includes a control circuit 71 for a drive control, a power source circuit 73, an X-driver 74, a Y-driver 77 and an address driver 80. The control circuit 71 includes a controller 711 and a data conversion circuit 712. The controller 711 includes a waveform memory for memorizing control data of driving voltages. The X-driver 74 switches potentials of n display electrodes X. The Y-driver 77 includes a scan circuit 78 and a common driver 79. The scan circuit 78 is potential switching means for row selection in the addressing. The common driver 79 switches potentials of n display electrodes Y. The address driver 80 switches potentials of total m address electrodes A in accordance with subframe data Dsf. These drivers are supplied with predetermined power from the power source circuit 73.

The drive unit 70 is supplied with frame data Df that are multi-valued image data indicating luminance levels of red, green and blue colors from an external device such as a TV tuner or a computer along with synchronizing signals CLOCK, VSYNC and HSYNC. The frame data Df are temporarily stored in a frame memory of the data conversion circuit 712 and then is transferred to the address driver 80 after being converted into subframe data Dsf for a gradation display. The subframe data Dsf are display data of q bits that indicate q subframes (i.e., a set of q screens of display data of one bit per subpixel). The subframe is a binary image having a resolution of m×n. The value of each bit of the subframe data Dsf indicates whether light emission is necessary or not for the subpixel in the corresponding one subframe, more specifically whether the address discharge is necessary or not.

Figure 9:
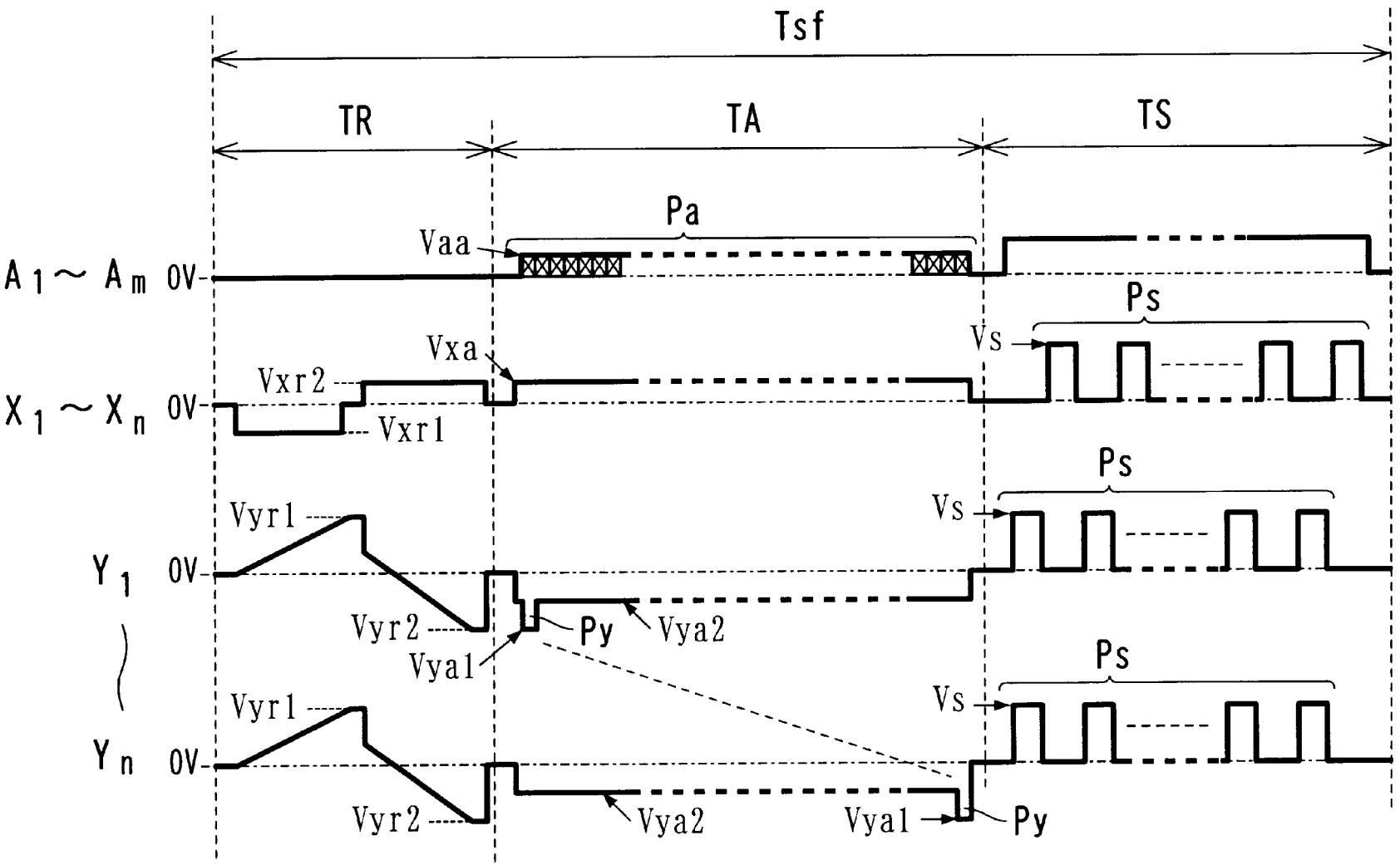
FIG. 9 is a diagram of voltage waveforms showing a general driving sequence.
Figure 10:
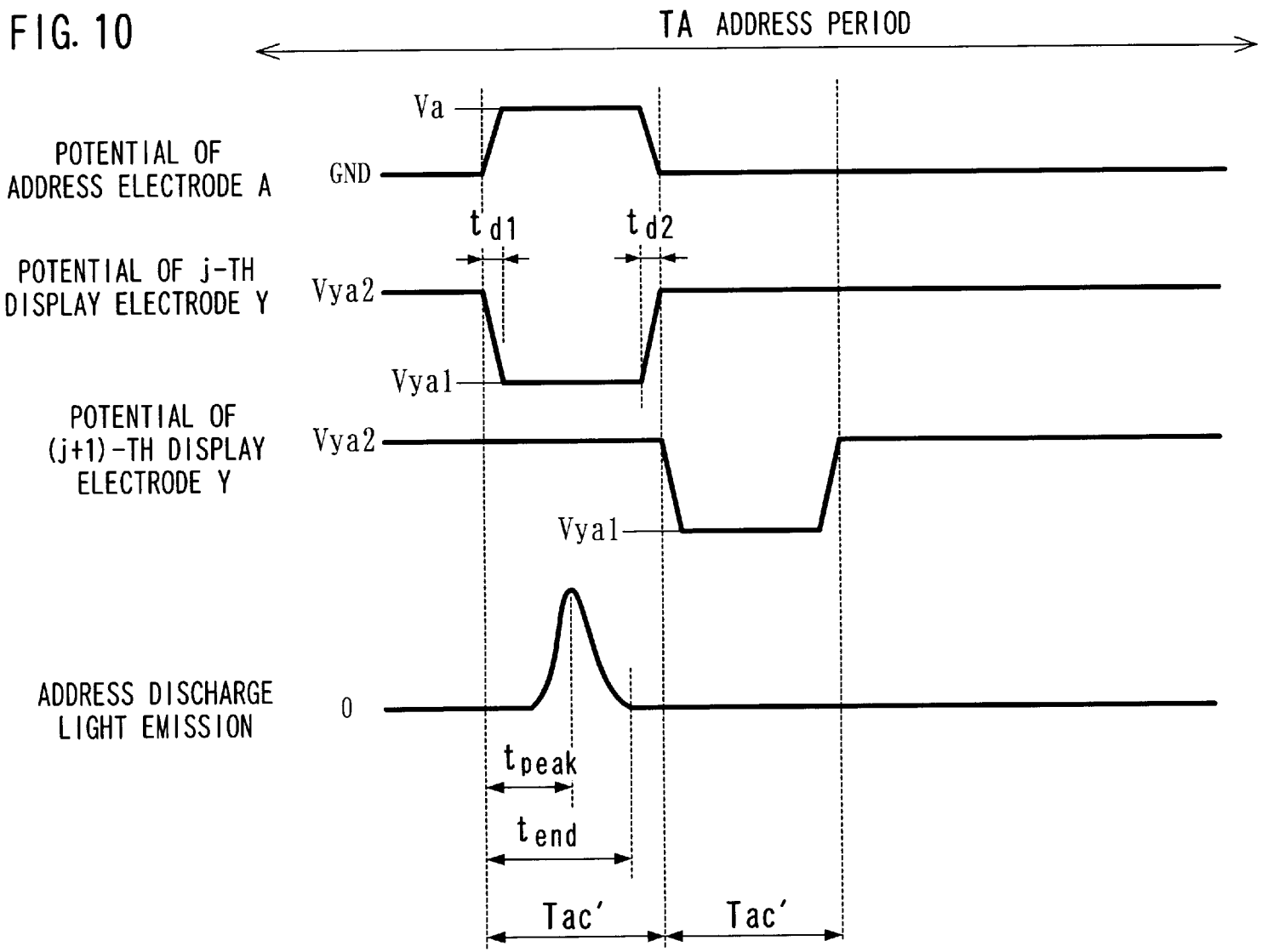
FIG. 10 is a timing chart of addressing in the conventional method.

The driving sequence of a color display using the display device 100 having the above-mentioned structure is basically the same as the driving sequence explained above with reference to FIG. 9. Namely, the frame is made of q subframes, and a reset period, an address period and a sustain period are assigned to each subframe for displaying the frame.

Figure 7:
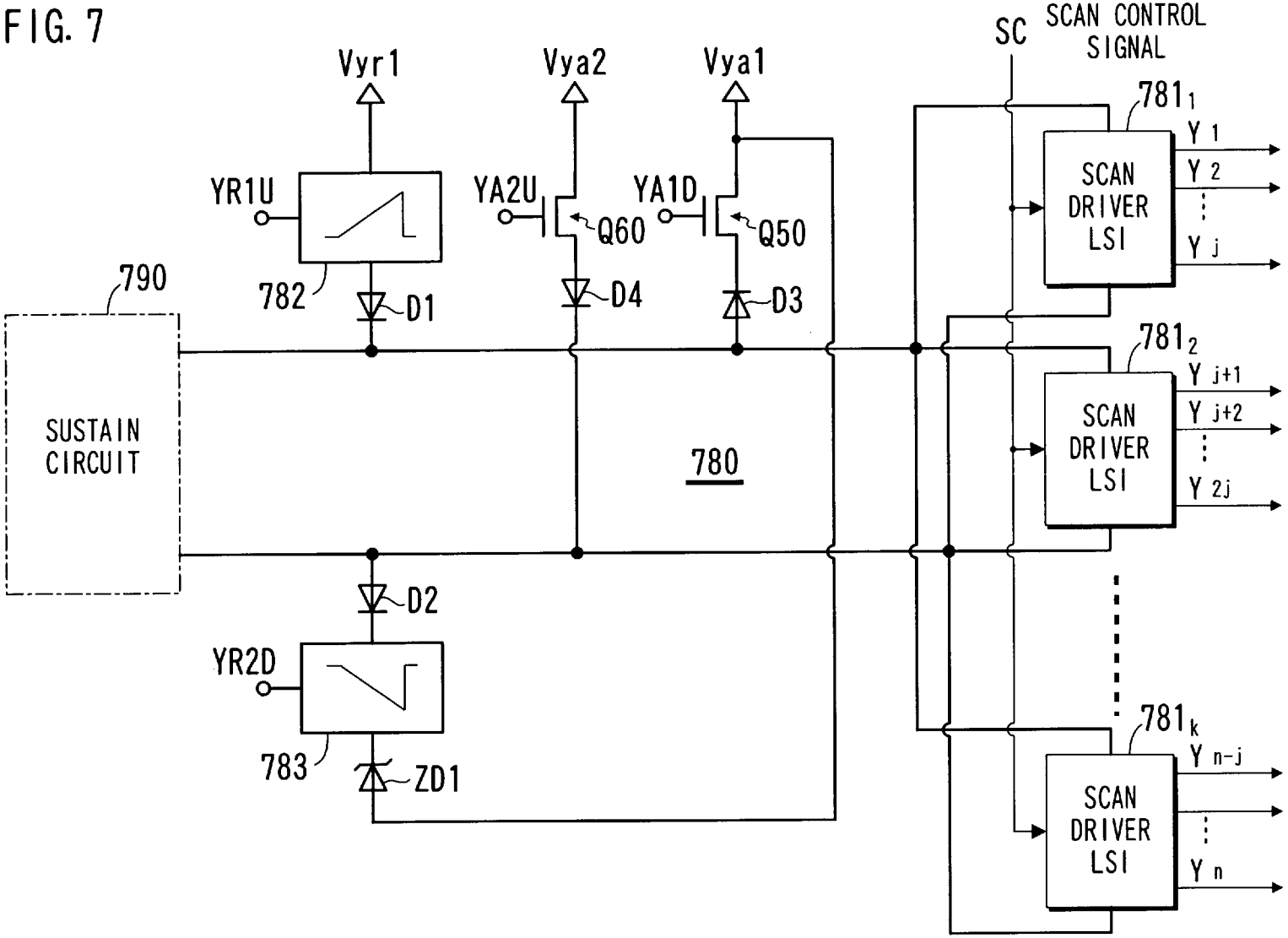
FIG. 7 is a schematic diagram of a scan circuit according to an embodiment of the present invention.
Figure 8:
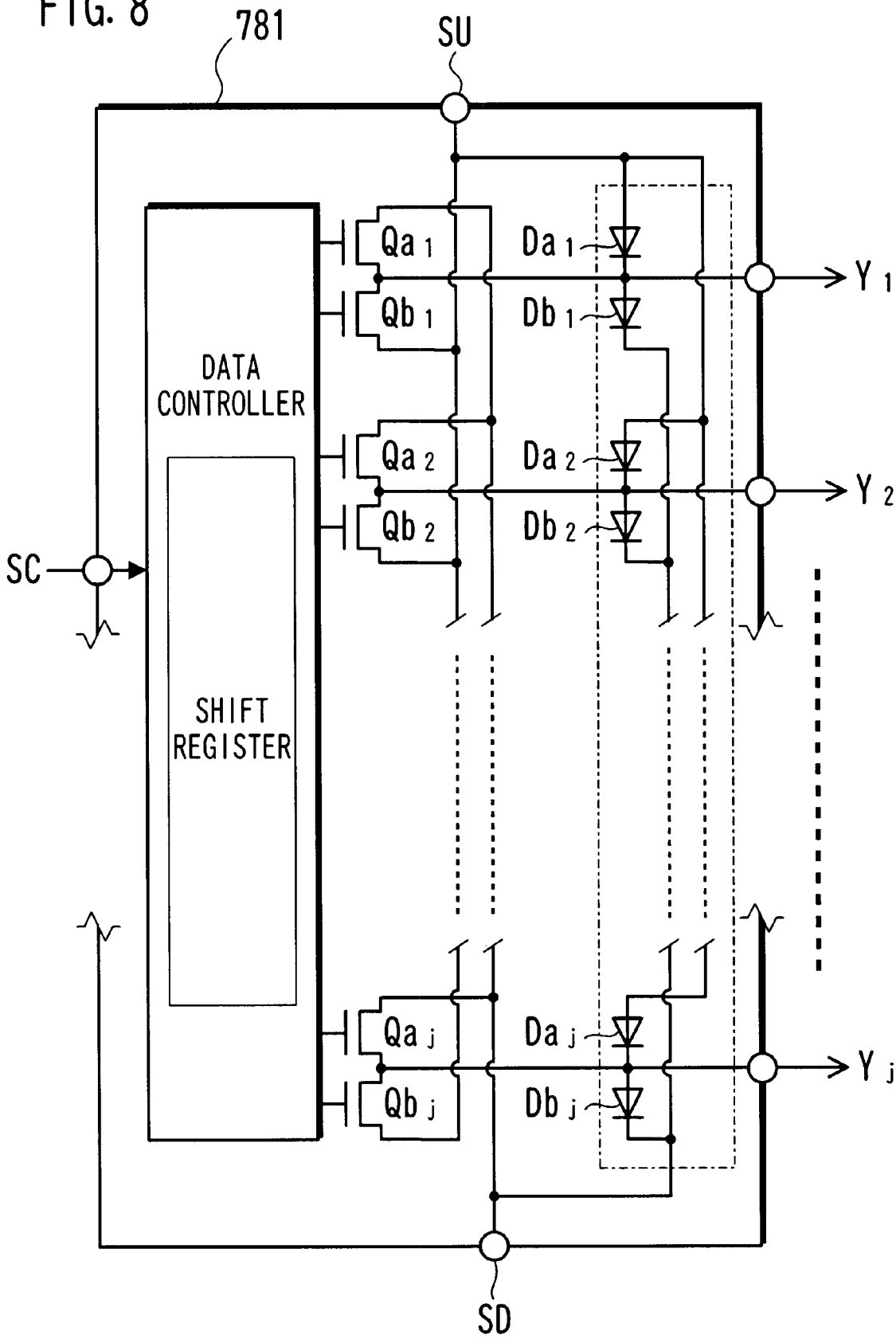
FIG. 8 is a schematic diagram of a switch circuit that is called a scan driver.

FIG. 7 is a schematic diagram of a scan circuit according to an embodiment of the present invention. FIG. 8 is a schematic diagram of a switch circuit that is called a scan driver. The scan circuit 780 includes plural scan drivers 781 for controlling potentials of n display electrodes Y individually in binary manner, two switches for switching voltages that are applied to the scan drivers (e.g., switching devices such as FETs) Q50 and Q60 and reset voltage circuits 782 and 783 for generating the increasing waveform voltage. Each of the scan drivers 781 is an integrated circuit device being in charge of controlling j display electrodes Y. In a typical scan driver 781 that is commercialized, j is approximately 60–120.

As shown in FIG. 8, in each of the scan drivers 781, a pair of switches Qa and Qb is arranged for each of j display electrodes Y, and j switches Qa are commonly connected to a power source terminal SD, while j switches Qb are commonly connected to a power source terminal SU. The display electrode Y is biased to the potential of the power source terminal SD at that time point when the switch Qa is turned on, while the display electrode Y is biased to the potential of the power source terminal SU at that time point when the switch Qb is turned on. A scan control signal SC from the control circuit 71 is imparted to the switches Qa and Qb via a shift register in the data controller, and shifting operation in synchronization with a clock realizes the row selection in a predetermined order. The scan driver 781 includes diodes Da and Db that make current paths when a sustain pulse is applied.

As shown in FIG. 7, the power source terminals SU of all the scan drivers 781 are commonly connected to the power source (the potential Vya1) via a diode D3 and a switch Q50 and are connected to the reset voltage circuit 782 via a diode D1. The power source potential of the reset voltage circuit 782 is Vyr1. Furthermore, power source terminals SD of all the scan drivers 781 are commonly connected to the power source (the potential Vya2) via a diode D4 and a switch Q60 and are connected to the reset voltage circuit 783 via a diode D2. In this example, the reset voltage circuit 783 is connected to the power source of the potential Vya1 as a power source input via a zener diode ZD1. A breakdown voltage of the zener diode ZD1 is ΔVy, and the connection direction of the zener diode ZD1 is opposite to the direction of the current between the reset voltage circuit 783 and the power source.

Figure 1:
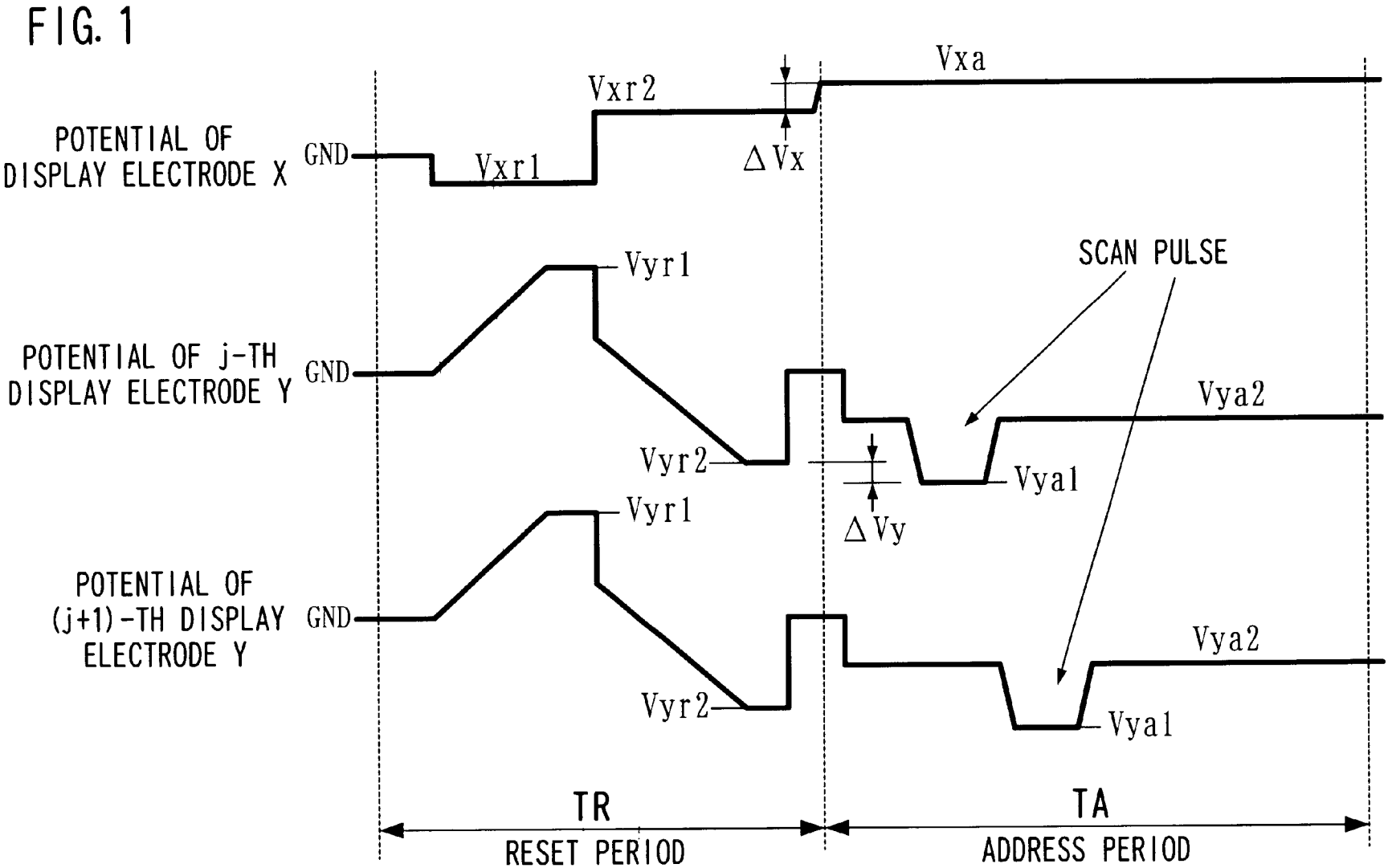
FIG. 1 is a diagram showing driving voltage waveforms according to the present invention.
Figure 2:
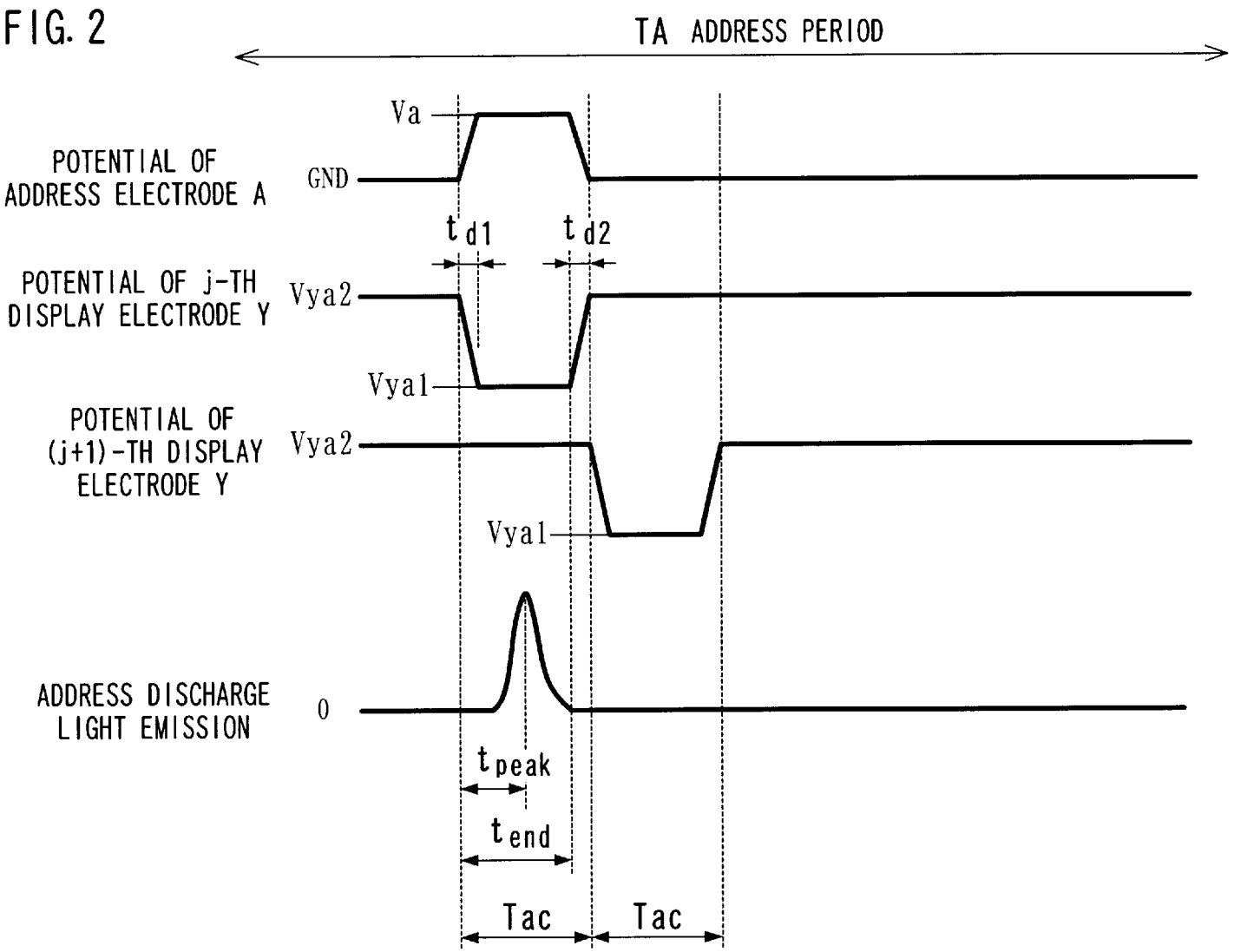
FIG. 2 is a timing chart of addressing according to the present invention.

As shown in FIG. 1 too, in the reset period TR, when the reset voltage circuit 782 is turned on by a control signal YR1U, the potential of the power source terminal SU alters toward the voltage Vyr1 at a predetermined rate (the potential increases in the example of FIG. 1). When the reset voltage circuit 783 is turned on by a control signal YR2D, the potential of the power source terminal SD descends to the voltage Vyr2 that is higher than the voltage Vya1 by ΔVy. At that time, the current from the display electrode Y flows through the scan driver 781 and the diode D2 and is controlled by the reset voltage circuit 783. Then, the current flows in the zener diode ZD1 in the opposite direction and flows into the power source (the potential Vya1). The opposite direction current continues to flow in the zener diode ZD1 until the difference between the potential of the display electrode Y and the power source potential Vya1 becomes below ΔVy. When the difference becomes equal to ΔVy, the current becomes shut off, and the display electrode Y maintains the potential at that time. In this way, by using the zener diode ZD1, and by selecting the breakdown voltage, the value of ΔVy can be set to a value within the range of 10–35 volts easily without changing the conventional circuit substantially.

In the address period TA, when a control signal YA1D turns on the switch Q50, the power source terminal SU is biased to the selection potential Vya1. When a control signal YA2U turn on the switch Q60, the power source terminal SD is biased to the non-selection potential Vya2. In the sustain period TS (see FIG. 9), the switches Q50 and Q60 and reset voltage circuits 782 and 783 are turned off, and all the switches Qa and Qb in the scan driver are turned off. Therefore, the potential of the power source terminals SU and SD depends on an operation of a sustain circuit 790. The sustain circuit 790 includes a switch for switching a potential of the display electrode Y to the sustaining potential Vs or the reference potential and a power recycling circuit for charging and discharging the capacitance at the interelectrode XY at high speed utilizing an LC resonance.

Figure 3:
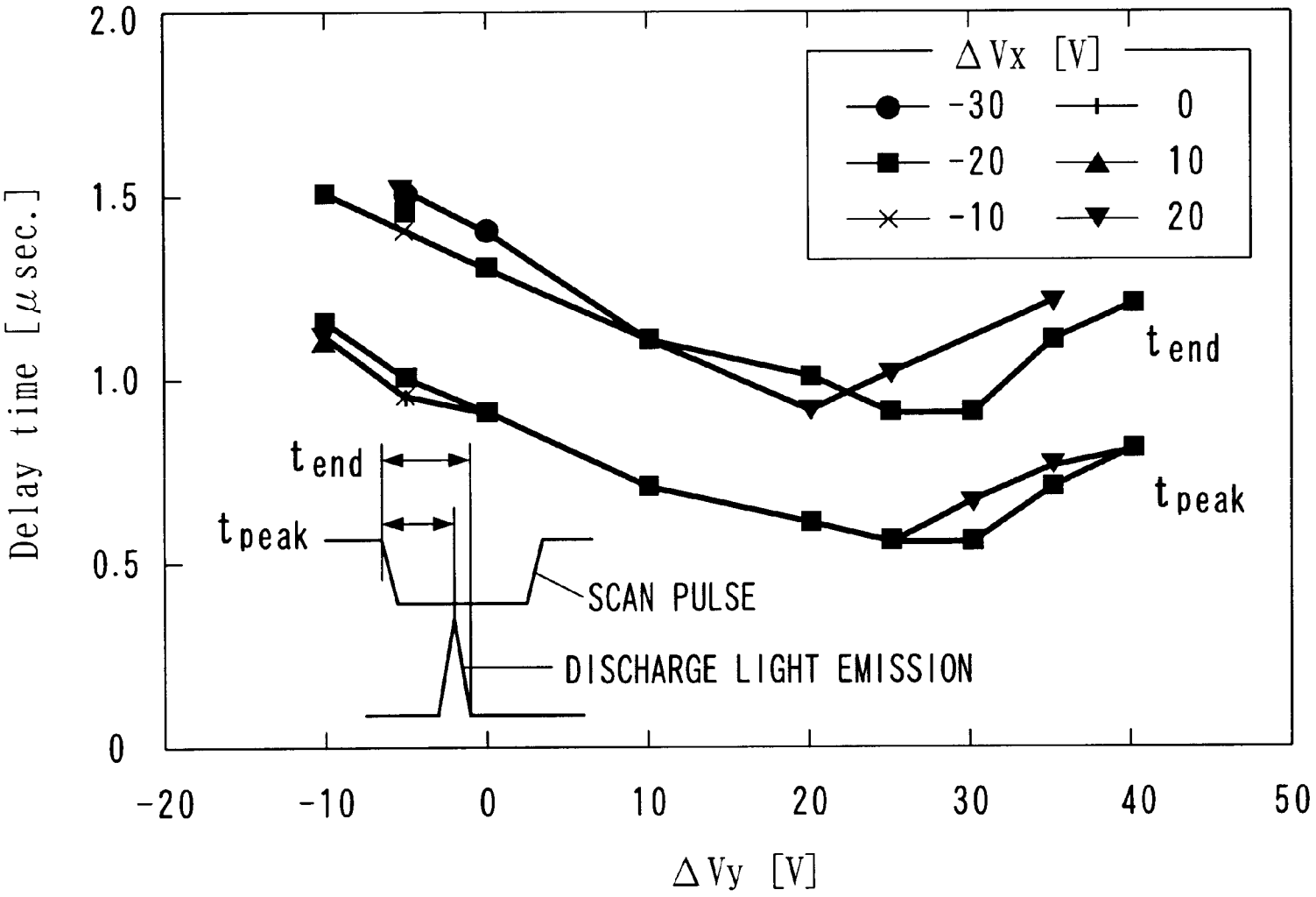
FIG. 3 is a graph showing the relationship between a voltage ΔVy and a delay time of address discharge.
Figure 4:
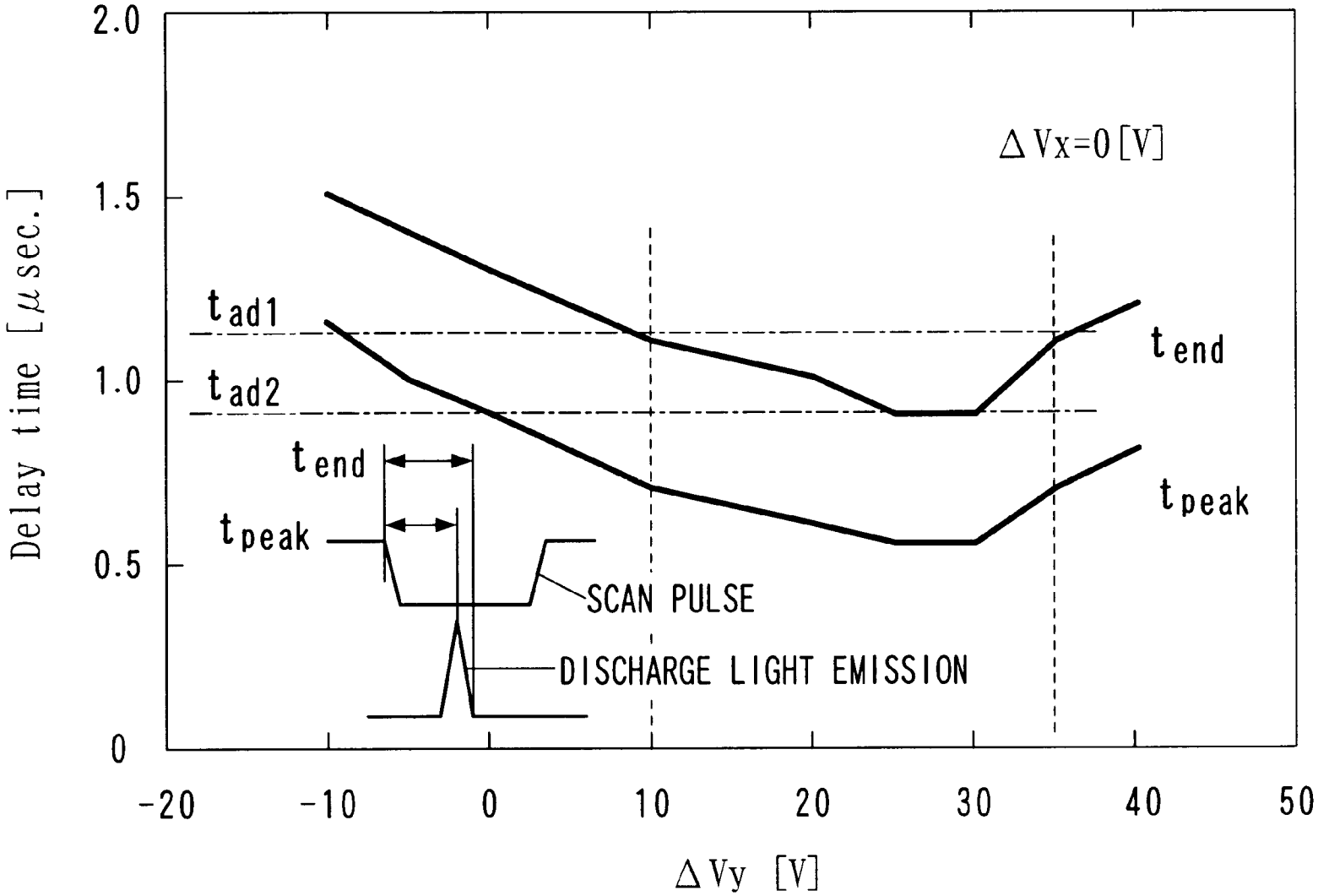
FIG. 4 is a graph showing the relationship between a voltage ΔVy and a delay time of address discharge.
Figure 5:
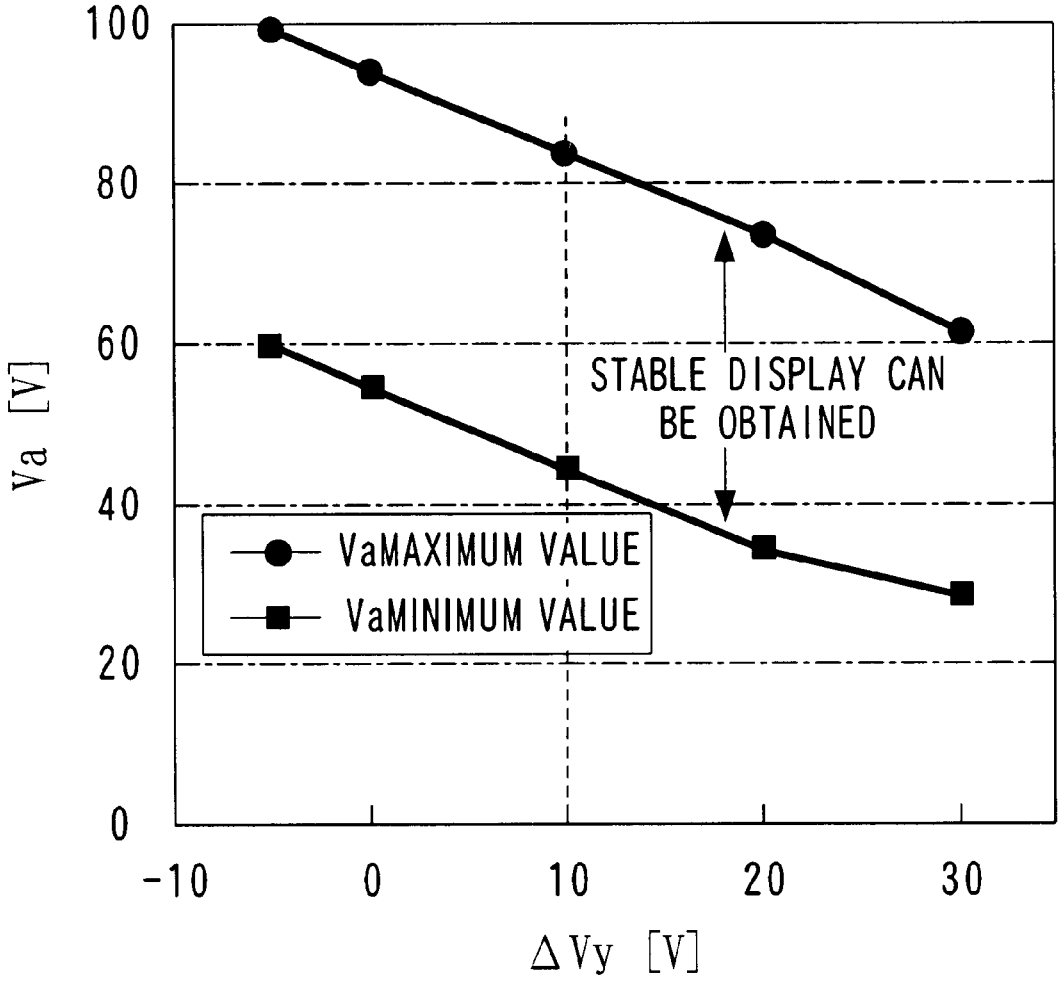
FIG. 5 is a graph showing a margin of an address voltage Va.

Hereinafter, setting of a drive condition will be explained. When embodying the present invention, the potential differences ΔVx and ΔVy and the address cycle Tac are set in accordance with the relationship between the delay time of the address discharge and the applied voltage. More specifically, if the PDP 1 has the characteristics shown in FIGS. 3–5, the conditions of ΔVx=0, 10 volts<ΔVy<35 volts, and 0.8 microseconds<Tac<1.4 microseconds are set.

For example, the conditions of ΔVx=0, ΔVy=25 volts, and Tac=1.0 microseconds are set. If the number of rows of the display screen is 500, the number of the subframes q is 10, and the reset period TR is 300 microseconds per subframe, the total sum of the time necessary for the reset process and the addressing is (300+1.0×500)×10=8000 microseconds (=8 milliseconds). The time that can be assigned to the sustain period is 16.7−8=8.7 milliseconds. In the conventional method, this time is 2.7 milliseconds, so the present invention can improve a maximum display light emission luminance (a peak luminance) substantially. If the address cycle Tac is shortened, it is also possible to improve reproducibility of the gradation by increasing the number of subframes, adding to the effect of increasing the number of display discharge times in the sustain period.

Furthermore, the bias potential of the display electrode X can be changed between the second half of the reset period and the address period by providing plural power sources and plural switches to the X-driver 74 as shown in the circuit of FIG. 7. In the case where the bias potential is not changed, i.e., ΔVx=0, the circuit can be realized at low cost by using a common power source for the bias of the potential Vxr2 and the bias of the potential Vxa.

For the present invention, the relationship between the electrode potential at the end of the reset period and that in the addressing period is important, but the waveforms in reset period are not limited. In the above example, the two-step process is explained in which an obtuse waveform whose voltage ascends and an obtuse waveform whose voltage descends are applied to the display electrode Y. However, the reset waveform can be made of three or more steps. Otherwise, the reset waveform can be made of one step (for example, an obtuse waveform whose voltage descends are applied to the display electrode Y).

In the above-explained embodiment, the number of discharge times can be increased by elongating the sustain period without deteriorating the stability of the address operation. In addition, image quality can be improved by increasing the number of subframes for finer gradation expression. The image quality can be improved without increasing a size of the display device or a weight of the device. In addition, the address voltage Va can be below 50 volts, so that power consumption in the addressing can be reduced compared to the conventional method.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A method for driving an AC type plasma display panel having a display screen of m×n cells and a three-electrode surface discharge structure in which a plurality of first display electrodes and a plurality of second display electrodes are arranged so as to constitute total n pairs of electrodes for surface discharge, and m address electrodes are arranged so as to cross the electrode pairs, the method comprising the steps of:

applying an increasing waveform voltage between a reference potential line and the second display electrode so that a voltage Vyr2 is applied between the second display electrode and the reference potential line at the end of a reset process for equalizing charge of all cells before addressing for controlling charge quantity of each cell in accordance with contents of a display by row selection in which the second display electrode is used as a scan electrode; and applying a voltage Vya1 having the same polarity as the voltage Vyr2 and an absolute value larger than the voltage Vyr2 by a potential difference ΔVy between a second display electrode corresponding to a selected row that is a part of the second display electrodes and the reference potential line in the addressing.

2. The method according to claim 1, further comprising the step of applying a bias voltage Vxa equal to the applied voltage at the end of the reset process or having an absolute value larger than the voltage by a potential difference ΔVx between the first display electrode and the reference potential line during the period from the start to the end of the addressing.

3. The method according to claim 1, wherein the potential difference ΔVy has a value within the range of 10–35 volts.

4. The method according to claim 1, wherein an address cycle Tac that is time necessary for addressing one row is set to a value within the range of 0.8–1.4 microseconds.

5. The method according to claim 1, wherein an address voltage that is the difference between a bias potential of an address electrode corresponding to a selected cell that generates address discharge and a potential of address electrodes corresponding to other cells is set to a value below 50 volts in the addressing.

6. A device for driving an AC type plasma display panel having a three-electrode surface discharge structure in which a plurality of first display electrodes and a plurality of second display electrodes are arranged so as to constitute total n pairs of electrodes for surface discharge, and m address electrodes are arranged so as to cross the electrode pairs, the device comprising:

a power source circuit for outputting power of a selection voltage Vya1; and a zener diode connected to the power source circuit in the opposite direction, so that a voltage Vyr2 having the same polarity as the selection voltage Vya1 and an absolute value smaller than the selection voltage Vya1 by a potential difference ΔVy can be applied, wherein an increasing waveform voltage is applied between a reference potential line and the second display electrode so that the voltage Vyr2 is applied between the second display electrode and the reference potential line at the end of a reset process for equalizing charge of all cells before addressing for controlling charge quantity of each cell in accordance with contents of a display by row selection in which the second display electrode is used as a scan electrode, and the selection voltage Vya1 is applied between a second display electrode corresponding to a selected row that is a part of the second display electrodes and the reference potential line in the addressing.

7. The device according to claim 6, wherein a breakdown voltage of the zener diode has a value within the range of 10–35 volts.

8. A display device comprising:

an AC type plasma display panel having a display screen of m×n cells and a three-electrode surface discharge structure in which a plurality of first display electrodes and a plurality of second display electrodes are arranged so as to constitute total n pairs of electrodes for surface discharge, and m address electrodes are arranged so as to cross the electrode pairs; and a device for driving the AC type plasma display panel, including a power source circuit for outputting power of a selection voltage Vya1, and a zener diode connected to the power source circuit in the opposite direction, so that a voltage Vyr2 having the same polarity as the selection voltage Vya1 and an absolute value smaller than the selection voltage Vya1 by a potential difference ΔVy can be applied, wherein an increasing waveform voltage is applied between a reference potential line and the second display electrode so that the voltage Vyr2 is applied between the second display electrode and the reference potential line at the end of a reset process for equalizing charge of all cells before addressing for controlling charge quantity of each cell in accordance with contents of a display by row selection in which the second display electrode is used as a scan electrode, and the selection voltage Vya1 is applied between a second display electrode corresponding to a selected row that is a part of the second display electrodes and the reference potential line in the addressing.

* * * * *